US007547837B1

(12) United States Patent
Heitman, II

(10) Patent No.: US 7,547,837 B1
(45) Date of Patent: Jun. 16, 2009

(54) SYSTEM AND METHOD FOR SELECTIVELY ACTIVATING ONE OR MORE FOOT ACTIVATION DEVICES

(76) Inventor: W. John Heitman, II, 3907 Golden Bear Ct., Apt. #733, Orlando, FL (US) 32839-3286

( * ) Notice: Subject to any disclaimer, the term of this patent is extended or adjusted under 35 U.S.C. 154(b) by 0 days.

(21) Appl. No.: 11/956,843

(22) Filed: Dec. 14, 2007

(51) Int. Cl.
*G10D 13/02* (2006.01)

(52) U.S. Cl. ..... 84/422.1; 84/312 P

(58) Field of Classification Search ..... 84/422.1, 84/312 P

See application file for complete search history.

(56) References Cited

U.S. PATENT DOCUMENTS

| | | | | |
|---|---|---|---|---|
| 3,241,394 | A | 3/1966 | Rubenstein | |
| 3,548,674 | A | 12/1970 | McGuire | |
| 3,995,510 | A | 12/1976 | Yost | |
| 4,245,527 | A | 1/1981 | Hildebrecht | |
| 4,299,136 | A | 11/1981 | Turi et al. | |
| 5,866,829 | A | 2/1999 | Pecoraro | |
| 5,990,401 | A | 11/1999 | Braun et al. | |
| 6,215,055 | B1 | 4/2001 | Saravis | |
| 6,255,574 | B1 | 7/2001 | Sapienza | |
| 6,545,204 | B1 * | 4/2003 | Wadell | 84/422.1 |
| 2006/0011052 | A1 * | 1/2006 | Purchon et al. | 84/746 |
| 2008/0173164 | A1 * | 7/2008 | Francis et al. | 84/721 |

* cited by examiner

*Primary Examiner*—Jeffrey Donels
*Assistant Examiner*—Jianchun Qin
(74) *Attorney, Agent, or Firm*—Cian G. O'Brien, Esq.; Terry M. Sanks, Esq.; Beusse Wolter Sanks Mora & Maire, P.A.

(57) ABSTRACT

A system is provided for selectively activating at least one foot activation device. The system includes an enclosure configured to hold the at least one foot activation device. Additionally, the system includes at least one handle coupled to a top portion of the enclosure, where each handle is positioned above a respective foot activation device and are mutually coupled to one another. Each handle is displaced in a direction toward the respective foot activation device such that each handle selectively activates the respective foot activation device.

10 Claims, 3 Drawing Sheets

SYSTEM AND METHOD FOR SELECTIVELY ACTIVATING ONE OR MORE FOOT ACTIVATION DEVICES

FIELD OF THE INVENTION

This invention relates to musical instruments, and more particularly to a system and method for selectively activating one or more foot activation devices while playing a musical instrument.

BACKGROUND OF THE INVENTION

When a musician plays a musical instrument, such as a guitar, the guitar is typically connected to an amplifier which may feature one or more acoustic channels to provide various acoustic effects while the musician plays the guitar. A conventional system may feature one or more foot activation devices, such as foot switches, for example, which are electrically coupled to the amplifier through the guitar. By selectively activating one of the foot switches a respective acoustic channel of the amplifier may be activated. Additionally, once an acoustic channel is activated, a conventional system additionally may feature other foot activation devices, such as musical effect pedals, for example, which are also electrically coupled to the amplifier through the guitar. When the musician is performing, if a particular acoustic effect provided by the activated acoustic channel of the amplifier is desired, the musician activates the appropriate musical effect pedal.

Although the conventional systems utilized by musicians do provide foot switches and musical effect pedals to selectively activate a respective acoustic channel and subsequently activate an acoustic effect of that particular acoustic channel, these conventional systems do not accommodate circumstances in which a musician desires simultaneous activation of an acoustic channel of an amplifier and an acoustic effect of that acoustic channel, or simultaneous activation of respective acoustic channels in multiple amplifiers. Accordingly, there is a need for a system to accommodate such circumstances.

BRIEF DESCRIPTION OF THE INVENTION

One embodiment of the present invention provides a system for selectively activating at least one foot activation device. The system includes an enclosure configured to hold the at least one foot activation device. Additionally, the system includes at least one handle coupled to a top portion of the enclosure, where each handle is positioned above a respective foot activation device and are mutually coupled to one another. Each handle is displaced in a direction toward the respective foot activation device such that each handle selectively activates the respective foot activation device.

Another embodiment of the present invention provides a system for selectively activating at least one of a plurality of channels of a musical amplifier. The system includes an enclosure configured to hold a plurality of foot activation devices. Additionally, the system includes a plurality of handles coupled to the enclosure, where the handles are positioned above a respective foot activation device. One or more of the handles are displaced in a direction toward the respective foot activation devices such that the one or more handles selectively activate a respective one or more foot activation devices.

Another embodiment of the present invention provides a method for selectively activating at least one foot activation device. The method includes enclosing the at least one foot activation device within an enclosure. Additionally, the method includes coupling at least one handle to a top portion of the enclosure. The method further includes positioning the at least one handle above a respective foot activation device. More particularly, the method includes displacing the at least one handle in a direction toward the at least one foot activation device. The method further includes selectively activating the at least one foot activation device upon displacing the at least one handle into contact with the at least one foot activation device.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE INVENTION

Figure 1:
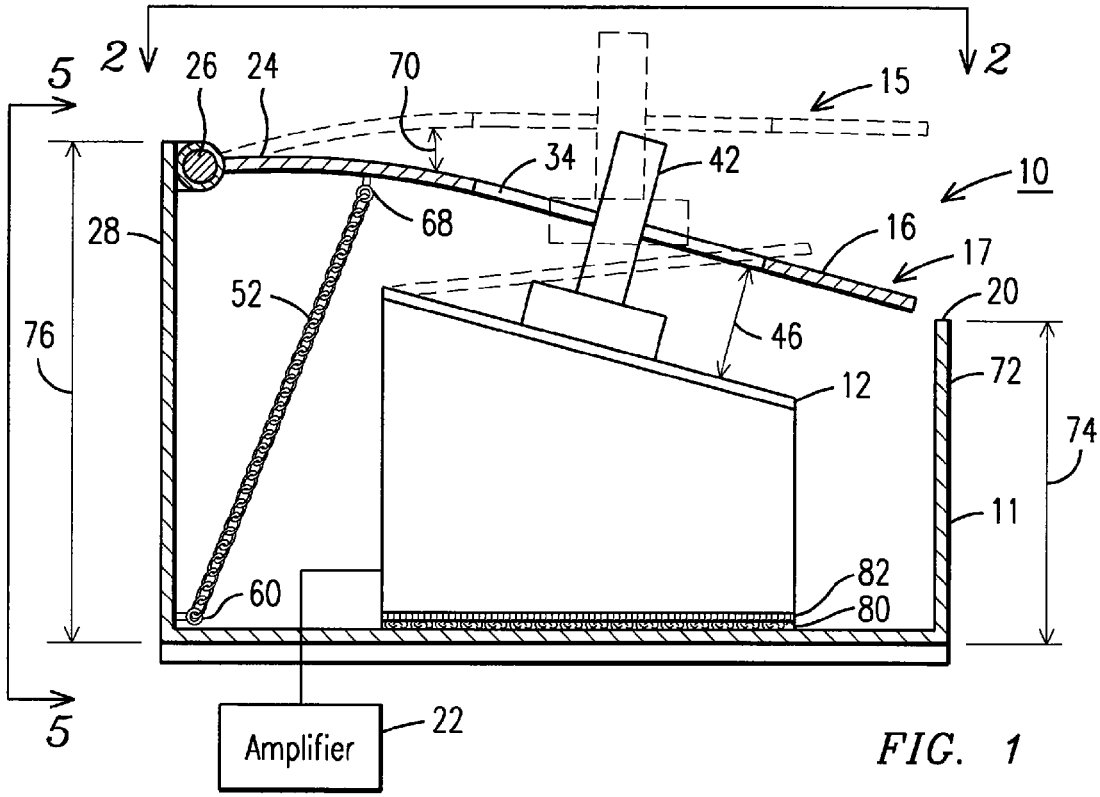
FIG. 1 depicts a side cross-sectional view of an exemplary embodiment of a system for selectively activating at least one foot activation device.

Reference will now be made in detail to the embodiments consistent with the invention, examples of which are illustrated in the accompanying drawings. Wherever possible, the same reference numerals used throughout the drawings refer to the same or like parts.

Figure 2:
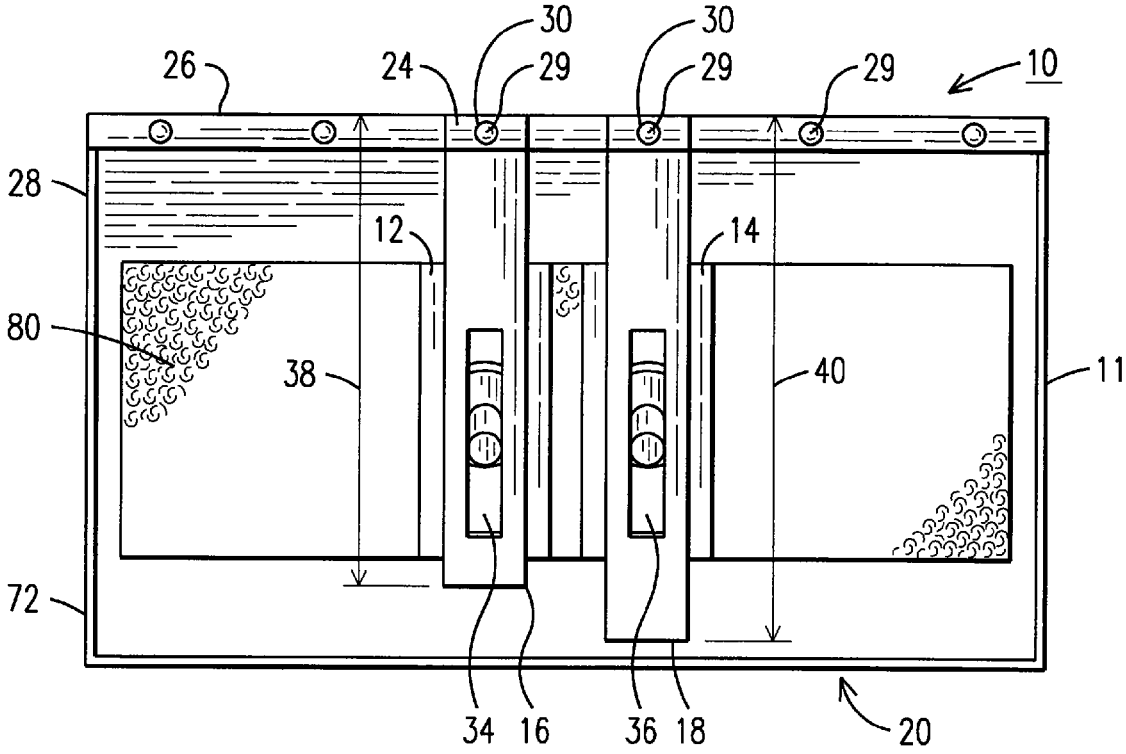
FIG. 2 depicts a top view of an exemplary embodiment of a system for selectively activating at least one foot activation device taken along the line 2-2 in FIG. 1.

FIG. 1 illustrates an exemplary embodiment of a system 10 for selectively activating one or more foot activation devices 12,14, which are electrically coupled to an amplifier 22. The foot activation devices 12,14 include a foot switch 12 to selectively activate a respective acoustic channel of the amplifier 22 upon selective activation of the foot switch 12. The foot activation devices 12,14 further include a musical effect pedal 14 to selectively activate a respective acoustic effect of the activated acoustic channel of the amplifier 22 upon selective activation of the musical effect pedal 14. As described in further detail below, an exemplary embodiment of the system 10 accommodates simultaneous activation of the foot switch 12 and the musical effect pedal 14, so that the musician can simultaneously activate an acoustic channel of the amplifier 22, and an acoustic effect on that activated acoustic channel. Although FIGS. 1-2 illustrate a system 10 having two foot activation devices including one foot switch 12 and one musical effect pedal 14 for a single amplifier 22, the embodiments of the present invention are not limited to this arrangement and may include more than one foot switch and/or more than one musical effect pedal, based on the musical arrangement. For example, in an exemplary embodiment of the present invention, for a musical arrangement of two amplifiers, two foot switches may be provided to selectively activate an acoustic channel on the two respective amplifiers, and two musical effect pedals may be provided to selectively activate an acoustic effect of the activated acoustic channel on each of the two respective amplifiers. As described in further detail below, upon simultaneous activation of all four of the two foot switches and the two musical effect pedals, the acoustic channels in the two respective amplifiers can be simultaneously activated, while the acoustic effects of those respective acoustic channels in the two respective amplifiers can also be simultaneously activated. Additionally, an exemplary embodiment of the present invention may feature one or more foot switches, without musical effect pedals, or one or more musical effect pedals, without foot switches, based on the musical arrangement and the needs of the musician.

As illustrated in the exemplary embodiments of FIGS. 1-2, the foot switch 12 and the musical effect pedal 14 are electrically coupled to an amplifier 22, which may subsequently be coupled to a musical instrument, such as an electrical guitar (not shown), for example. The musician may selectively activate an acoustic channel of the amplifier 22 by selectively activating the foot switch 12. Additionally, the musician may selectively activate an acoustic effect of the activated acoustic channel by selectively activating the musical effect pedal 14. For example, the amplifier 22 may have a clean channel, an overdrive 1 channel, and an overdrive 2 channel, and upon activation of a channel, the respective channel may provide distinct acoustic effects when activated, as appreciated by one of skill in the art. In order for a musician to activate an acoustic channel on the amplifier 22, the musician selectively activate the foot switch 12, so as to activate the overdrive 1 channel from the clean channel or may simultaneously activate both of the foot switch 12 and the musical effect pedal 14 in order to activate the overdrive 1 channel and to simultaneously activate an acoustic effect of the overdrive 1 channel. The embodiments of the system 10 described below assist the musician in selectively activating one or more of the foot activation devices 12,14.

As further illustrated in the exemplary embodiments of FIGS. 1-2, the system 10 includes an enclosure 11 which is configured to hold the foot switch 12 and musical effect pedal 14. Additionally, the system 10 includes a pair of handles 16,18 which are respectively coupled to a top perimeter 20 of the enclosure 11. Although the pair of handles 16,18 are respectively coupled to the top perimeter 20 of the enclosure 11, these pair of handles 16,18 may be coupled to any portion of the enclosure 11, including a top portion, for example. As illustrated in the exemplary embodiment of FIG. 2, the pair of handles 16,18 are positioned above a respective foot switch 12 and musical effect pedal 14. As previously discussed, the enclosure 11 may include more than two foot activation devices, such as two foot switches and two musical effect pedals in a musical arrangement with two amplifiers, for example. Although FIG. 2 illustrates two handles 16,18 coupled to the top perimeter 20 of the enclosure 11, more than two handles may be provided so to be positioned above the more than two foot activation devices. Prior to performing, the musician may assess how many amplifiers and/or how many acoustic effects within the acoustic channels are desired, and position the appropriate number of foot switches and/or musical effect pedals within the enclosure, with a respective handle positioned above the foot switches and/or musical effect pedals.

Figure 3:
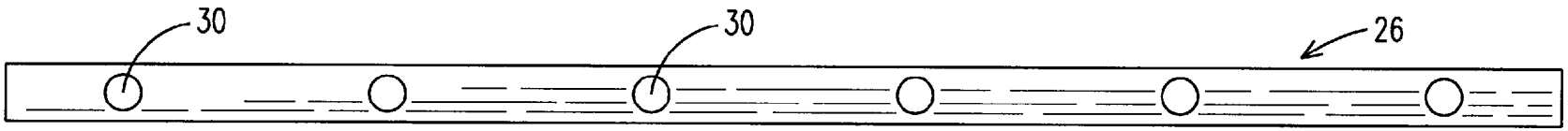
FIG. 3 depicts an isolated top view of an exemplary embodiment of the spring-loaded bar illustrated in FIG. 2.
Figure 4:
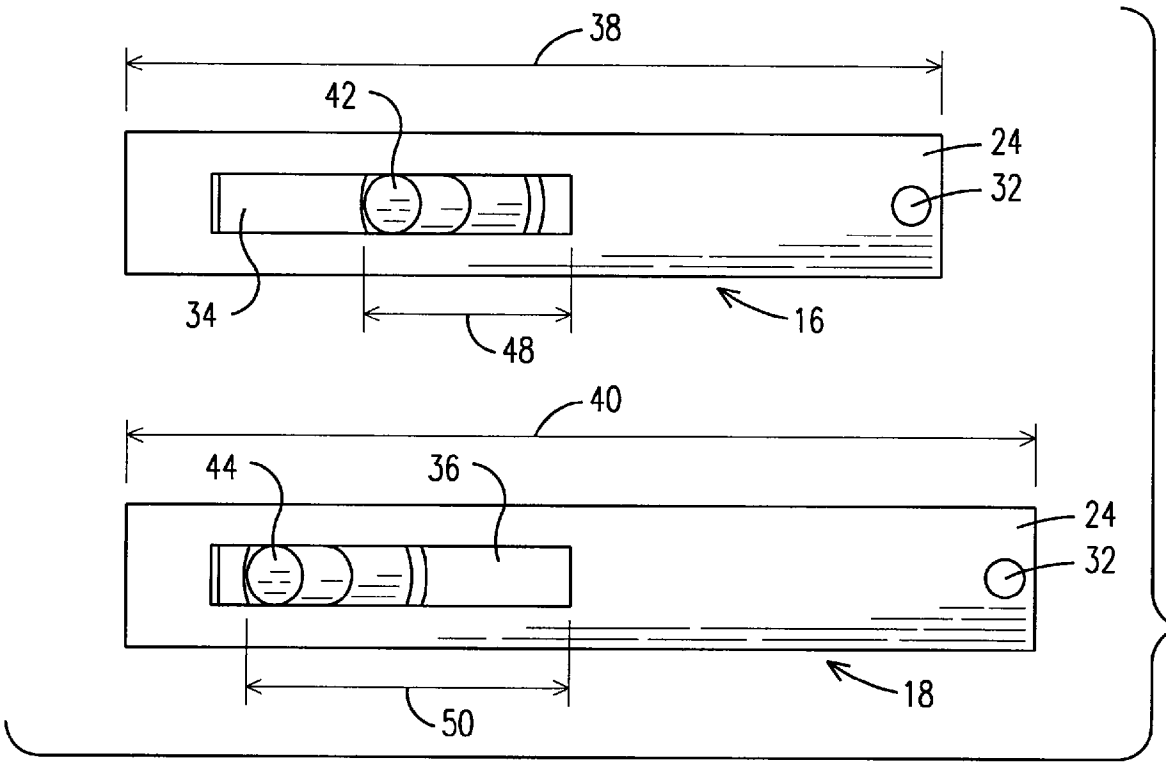
FIG. 4 depicts an isolated top view of an exemplary embodiment of the handles illustrated in FIG. 2.

As illustrated in the exemplary embodiment of FIG. 1, a first end 24 of the handle 16 is coupled to a spring loaded bar 26 mounted along a first side 28 of the top perimeter 20. As illustrated in FIGS. 2-4, in securing the first end 24 of the handle 16 to the spring loaded bar 26, a fastener 29 is passed through a respective opening 30 in the spring loaded bar 26 and a handle opening 32 adjacent to the first end 24. As illustrated in FIG. 3, the openings 30 within the spring loaded bar 26 may be equally spaced or irregularly spaced, based upon the positioning of the foot switch 12 and the musical effect pedal 14 and thus corresponding position of the respective handles 16,18. The spring loaded bar 26 is configured to rotate the handle 16 away from the foot switch 12 and the musical effect pedal 14. Although FIG. 1 illustrates a first handle 16, a second handle 18 is similarly connected to the spring loaded bar 26 and the enclosure 11. The handles 16,18 are mutually coupled to one another, as they are mutually coupled to the common spring loaded bar 26. Accordingly, when the first handle 16 is displaced toward the foot switch 12, the second handle 18 consequently is displaced toward the musical effect pedal 14 by virtue of their common coupling to the spring loaded bar 26, and vice versa. This mutual coupling is equivalent for any embodiment of the present invention employing more than two handles coupled to the spring loaded bar 26. Additionally, although a spring loaded bar 26 is illustrated as tending to rotate the handles 16,18 away from their respective foot switch 12 and musical effect pedal 14, any equivalent structure which accomplishes this function may be used.

Figure 5:
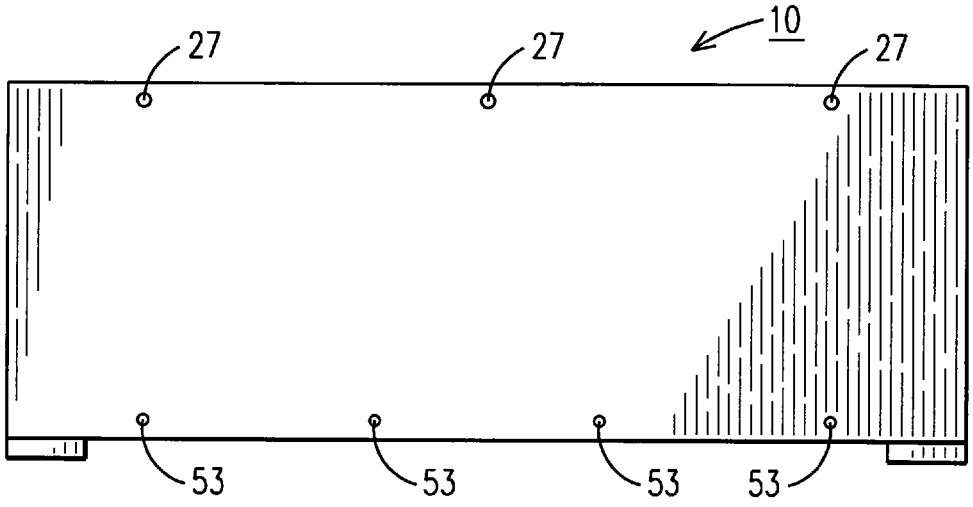
FIG. 5 depicts a rear plan view of an exemplary embodiment of a system for selectively activating at least one foot activation device taken along the line 5-5 in FIG. 1.

As further illustrated in FIG. 1, a link 52, such as a chain, for example, connects to a link portion 68 of the first handle 16 and to an internal portion 60 of the enclosure 11, such an inner corner of the enclosure 11 along a base of the enclosure 11 and below the first side 28 of the top perimeter 20, for example. As illustrated in FIG. 1, and discussed in further detail below, when selectively activating the foot switch 12, the first handle 16 is displaced from an open position 15 to a closed position 17, and in the process rotating through a predetermined angle 70. Accordingly, the foot switch 12 is activated once the first handle 16 is displaced to the closed position 17. The link 52 prevents the first handle 16 from rotating by more than the predetermined angle 70 and beyond the open position 15 (i.e., resisting rotation from the spring loaded bar 26), which is a plane defined by the top perimeter 20 of the enclosure 11. In an exemplary embodiment, four links are connected along the internal portion 60, such as the inner corner described above, and FIG. 5 illustrates respective link holes 53 through which individual fasteners are passed to secure each link to the internal portion 60. In the exemplary embodiment, each of the four links are respectively coupled at one end to the internal portion 60 and at a second end to the spring loaded bar 26. FIG. 5 also illustrates three holes 27 through which fasteners are passed into the spring loaded bar 26, to secure the spring loaded bar 26 to the enclosure 11. Although FIG. 5 illustrates four link holes to secure four links, more or less than four link holes may be used and positioned at an alternate location on the enclosure surface to secure more or less than four link holes. Additionally, although FIG. 5 illustrates three holes 27 to pass fasteners to secure the spring loaded bar 26, more or less than three fastener holes may be utilized.

As further illustrated in the exemplary embodiment of FIG. 1, the enclosure 11 includes a second side 72 of the top perimeter 20 opposite from the first side 28 of the top perimeter 20. The second side 72 has a reduced height 74 from the first side height 76. Although FIG. 1 illustrates the second side 72 having a reduced height 74 compares to the first side height 76, the second side 72 may have an equal height or greater height than the first side height 76. Additionally, a fastening material 80, such as Velcro®, for example, is positioned along an interior base of the enclosure 11, where the fastening material 80 is configured to secure to a fastening material 82, also such as Velcro®, for example, positioned along a base of the foot switch 12 to secure the foot switch 12 to the interior base within the enclosure 11. The musical effect pedal 14 may be similarly secured to the interior base of the enclosure 11 as the foot switch 12. In an exemplary embodiment, the foot switch 12 and the musical effect pedal 14 may be secured to the enclosure 11 using fasteners passed through respective holes in the frame of the enclosure.

Upon displacing one of the handles 16,18 in a direction toward the respective foot switch 12 and the musical effect pedal 14, the respective handles 16,18 are configured to selectively activate the respective foot switch 12 and the musical effect pedal 14. However, prior to displacing the handles 16,18 toward the foot switch 12 and the musical effect pedal 14, the relative positioning of the handles 16,18 and the foot switch 12 and the musical effect pedal 14 should be adjusted so that the handles 16,18 are capable of activating the foot switch 12 and the musical effect pedal 14 and the appropriate foot switch 12 and the musical effect pedal 14 are activated, based on the needs of the musician.

As illustrated in FIGS. 2 and 4, the handles 16,18 include a respective slot 34,36 in a direction parallel to the respective length 38,40 of the handles. A respective adjustable member 42,44, such as a rubber stopper, for example, is positioned within the respective slot 34,36. The adjustable member 42,44 is selectively positioned within the respective slot 34,36 in order to contact the respective foot switch 12 and the musical effect pedal 14 upon displacing the respective handle 16,18 toward the foot switch 12 and the musical effect pedal 14 to activate the foot switch 12 and the musical effect pedal 14. Also, the foot switch 12 and the musical effect pedal 14 may be adjusted, particularly its height within the enclosure 11, to make sure that the respective adjustable member 42,44 is capable of activating the foot switch 12 and the musical effect pedal 14 upon displacing the respective handle 16,18. The adjustable member 42,44 position within the respective slot 34,36 may be varied by varying a protruding length 46 (FIG. 1) of the adjustable member 42 through the slot 34 in a direction toward the foot switch 12 and/or varying a lateral position 48,50 (FIG. 4) of the adjustable member 42,44 within the slot 34,36 based upon sliding the adjustable member 42,44 within the slot 34,36. Additionally, the adjustable member 42,44 for a respective handle 16,18 may be removed from the respective slot 34,36, for circumstances in which the musician does not desire to activate the respective foot switch 12 and the musical effect pedal 14. The selective positioning of the adjustable member 42,44 may be based on a distance between the handle 16,18 and the foot switch 12 and the musical effect pedal 14.

Figure 6:
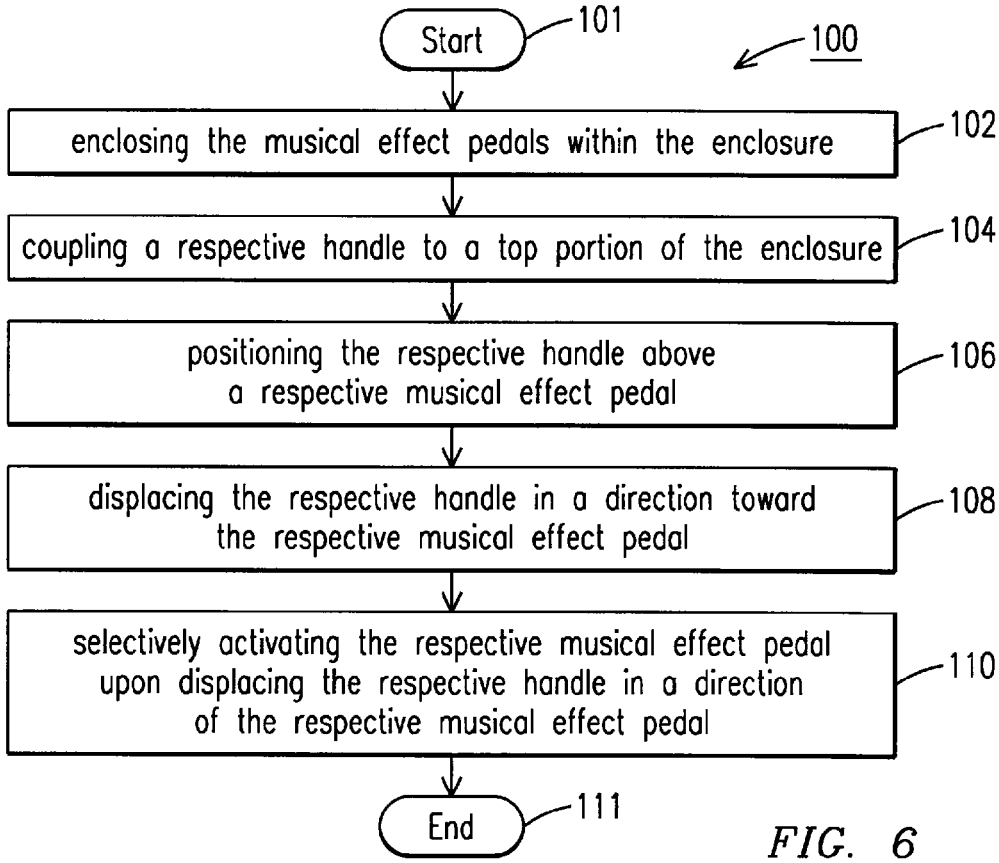
FIG. 6 depicts a flow chart illustrating an exemplary embodiment of a method for the system for selectively activating at least one foot activation device shown in FIG. 1.

FIG. 6 illustrates an exemplary embodiment of a method 100 for selectively activating one or more foot activation devices 12,14. The method 100 begins at block 101 by enclosing (block 102) the foot activation devices 12,14 within the enclosure 11. Additionally, the method 100 includes coupling (block 104) a respective handle 16,18 to a top portion 20 of the enclosure 11. The method 100 further includes positioning (block 106) the respective handle 16,18 above a respective foot activation device 12,14. The method 100 further includes displacing (block 108) the respective handle 16,18 in a direction toward the respective foot activation device 12,14. The method 100 further includes selectively (block 110) activating the respective foot activation device 12,14 upon displacing 108 the respective handle 16,18 in a direction of the respective foot activation device 12,14, before ending at block 111.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A system for selectively activating at least one foot activation device, comprising:

an enclosure configured to hold said at least one foot activation device; and at least one handle coupled to a top portion of said enclosure, said at least one handle being positioned above a respective foot activation device, said at least one handle being mutually coupled;

wherein said at least one handle is displaced in a direction toward said at least one foot activation device such that said at least one handle selectively activates said at least one foot activation device;

wherein said at least one foot activation device is electrically coupled to an amplifier, said at least one foot activation device comprises;

at least one foot switch configured to selectively activate a respective acoustic channel of an amplifier upon said selective activation of said at least one foot switch, at least one musical effect pedal configured to selectively activate a respective acoustic effect of said activated acoustic channel of said amplifier upon said selective activation of said at least one musical effect pedal, and wherein said top portion is a top perimeter of said enclosure, a first end of said at least one handle is coupled to a spring loaded bar mounted along a first side of said top perimeter, said spring loaded bar is configured to rotate said at least one handle away from said foot activation device.

2. The system of claim 1, comprising a plurality of handles, and a respective plurality of foot activation devices; said first end of said handles are secured through a respective opening in said spring loaded bar along said first side of said top perimeter.

3. The system of claim 2, wherein said handles include a respective slot in a direction parallel to the length of said handles, and a respective adjustable member positioned within said slot; said adjustable member being selectively positioned within said respective slot to contact said respective foot activation device upon displacing said respective handle toward said foot activation device to activate said foot activation device.

4. The system of claim 3, wherein said selective positioning of said adjustable member comprises at least one of varying a protruding length of said adjustable member through said slot in a direction toward said foot activation device, and varying a lateral position of said adjustable member within said slot based upon sliding said adjustable member within said slot, said selective positioning is based on a distance between said handle and said respective foot activation device.

5. The system of claim 1, further comprising at least one link configured to connect a respective handle to an internal portion of said enclosure, said link configured to prevent said handle from rotating by more than a predetermined angle beyond a plane defined by said top perimeter of said enclosure.

6. The system of claim 5, wherein said enclosure comprises a second side of said top perimeter opposite from said first side of said top perimeter, said second side having a reduced height from said first side.

7. A system for selectively activating at least one of a plurality of channels of a musical amplifier, comprising:

an enclosure configured to hold a plurality of foot activation devices; and a plurality of handles coupled to said enclosure, said handles being positioned above a respective foot activation device and coupled to a top portion of said enclosure, said handles being mutually coupled such that said handles are simultaneously displaced;

wherein at least one of said handles are displaced in a direction toward said respective foot activation device such that said at least one handle selectively activates at least one of said foot activation devices;

wherein said plurality of foot activation devices are electrically coupled to an amplifier, said plurality of foot activation devices comprising;

a plurality of foot switches configured to selectively activate a respective acoustic channel of said amplifier upon said selective activation of said foot switches, a plurality of musical effect pedals configured to selectively activate a respective acoustic effect of said activated acoustic channel of said amplifier upon said selective activation of said musical effect pedals, and wherein said top portion is a top perimeter of said enclosure, a first end of said handles are coupled to a spring loaded bar mounted along a first side of said top perimeter, said spring loaded bar is configured to rotate said handles away from said foot activation devices.

8. The system of claim 7, wherein said first end of said handles are secured through a respective opening in said spring loaded bar along said first side of said top perimeter.

9. The system of claim 8, wherein said handles include a respective slot in a direction parallel to the length of said handles, and a respective adjustable member positioned within said slot; said adjustable member being selectively positioned within said respective slot to contact said respective foot activation device upon displacing said respective handle toward said foot activation device to activate said foot activation device.

10. The system of claim 9, wherein said selective positioning of said adjustable member comprises at least one of varying a protruding length of said adjustable member through said slot in a direction toward said foot activation device, and varying a lateral position of said adjustable member within said slot based upon sliding said adjustable member within said slot, said selective positioning is based on a distance between said handle and said respective foot activation device.

* * * * *